United States Patent [19]

Kozacka

[11] 4,308,514

[45] Dec. 29, 1981

[54] CURRENT-LIMITING FUSE

[75] Inventor: Frederick J. Kozacka, South Hampton, N.H.

[73] Assignee: Gould Inc., Rolling Meadows, Ill.

[21] Appl. No.: 171,558

[22] Filed: Jul. 23, 1980

[51] Int. Cl.[3] ..... H01H 85/10

[52] U.S. Cl. ..... 337/159; 337/161; 337/292

[58] Field of Search ..... 337/158, 159, 160, 161, 337/162, 290, 291, 292, 293, 294, 295, 296

[56] References Cited

U.S. PATENT DOCUMENTS 2,653,203 9/1953 Kozacka ..... 337/160

*Primary Examiner*—Harold Broome

*Attorney, Agent, or Firm*—Erwin Salzer

[57] ABSTRACT

A current-limiting fuse including a fusible element that comprises a relatively long portion of sheet copper and one or two end portions of sheet silver. The portions of sheet silver are each shorter than the portion of sheet copper. The portion of sheet copper is perforated, establishing points of reduced cross-section. The portion or portions of sheet silver are likewise perforated. The points of reduced cross-section established by the perforation, or perforations, in the portion or portions of sheet silver have a considerably smaller cross-section than the points of reduced cross-section in the portion of sheet copper.

3 Claims, 8 Drawing Figures

CURRENT-LIMITING FUSE

BACKGROUND OF THE INVENTION

The closest prior art known is U.S. Pat. No. 2,653,203; 09/22/53 to F. J. Kozacka for CURRENT-LIMITING FUSE. This patent discloses a fuse having one or more fusible elements of a singel metal, rather than a fuse having a composite fusible element made of two different metals. While the fuse according to the above patent and the fuse according to this invention are based on the same principle, the instant fuse has great advantages over the above prior art fuse—particularly as current-carrying capacity is concerned—as will become more apparent from what follows.

SUMMARY OF THE INVENTION

A current-limiting fuse according to this invention includes a casing of electric insulating material, preferably of a synthetic-resin glass-cloth laminate. There is a pulverulent arc-quenching filler inside the casing and the latter is closed on both ends thereof by a pair of electro-conductive terminal elements. A fusible element is embedded in said arc-quenching filler and conductively interconnects said pair of terminal elements. The fusible element includes a relatively long portion of sheet copper having at least one point of reduced cross-section. Said fusible element further includes at least one relatively short end portion of sheet silver conductively interconnecting one of said pair of terminal elements and one end of said portion of sheet copper. Said portion of sheet silver has a single point of reduced cross-section, and said single point has a smaller cross-section than any point of reduced cross-section in said portion of sheet copper.

DESCRIPTION OF PREFERRED EMBODIMENTS

Figure 1:
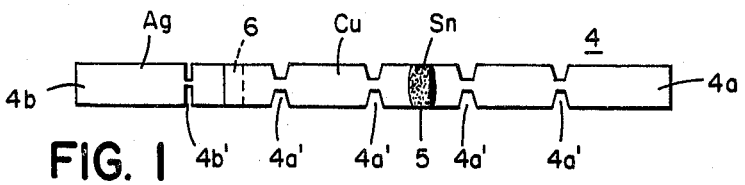
FIG. 1 is a top-plan view of a fusible element according to the present invention.
Figure 2:
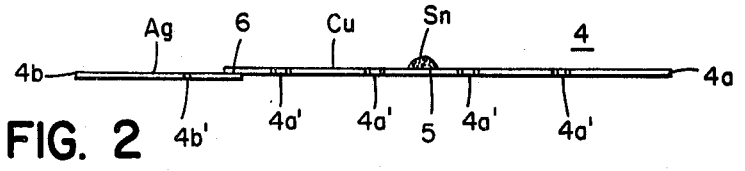
FIG. 2 is a side elevation of the fusible element shown in FIG. 1.
Figure 4:
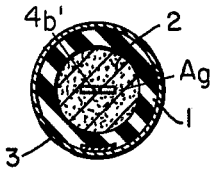
FIG. 4 is a cross-section of the fuse shown in FIG. 3 along IV—IV of FIG. 3.
Figure 3:
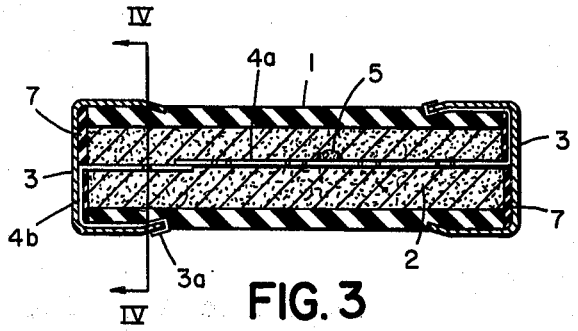
FIG. 3 is a longitudinal section of a fuse including a fusible element as shown in FIGS. 1 and 2.

Referring now to FIGS. 1 to 4, numeral 1 has been applied to indicate a tubular casing of electric insulating material, preferably a synthetic resin glass-cloth laminate which is filled with a granular arc-quenching filler 2, e.g. quartz sand. A pair of electro-conductive terminal elements 3 close the ends of casing 1. Terminal elements 3 may, for instance, be in the shape of caps mounted on the outer ends of casing 1. A fusible element generally indicated at 4 embedded in arc-quenching filler 2 conductively interconnects said pair of terminal elements. Fusible element 4 includes a relatively long portion 4*a* of sheet copper having at least one point of reduced cross-section. As shown in the drawings, sheet copper portion 4*a* has four serially arranged points of reduced cross-section 4*a'* to generate a relatively high arc voltage upon fusion thereof. Fusible element 4 further includes at least one relatively short end portion 4*b* of sheet silver conductively connecting one of said pair of terminal elements 3 and one end of said portion of sheet copper 4*a*. The end portion 4*b* of sheet silver has one single point of reduced cross-section 4*b*. The provision of an overlay 5 of an M-effect metal is optional. As generally known in the art, M-effect overlays are used either when it is desired to limit the highest temperature which a fuse may reach, or when it is desired to provide overload protection in addition to short-circuit protection. The portions 4*a*, 4*b* of the fusible element 4 overlap at 6 and are conductively bonded together at the point where they overlap as, for instance, by spot welding. The portion of sheet silver 4*b* is inserted into a slot in a washer 7 of fibrous material, bent a first time 90 deg. at the center of cap 3, then bent a second time 90 deg. about the rim of casing 1 and bent at its end to the outer surface of cap 3. The left end of sheet silver portion 4*b* is spot-welded at 3*a* to the left terminal cap 3. This mode of conductively connecting portion 4*b* of fusible element 4 to the left cap 3 is, however, not the most economical since it requires a relatively long length for silver portion 4*b* of fusible element 4.

In view of the recent steep increase in the price of silver it is desirable to keep the silver portion 4*b* of fusible element 4 as short as possible. This is not achieved in FIG. 3 of the drawing since the fusible silver section 4*b* is shown to be bent to outer surface of the casing, bent around the axially inner edge of terminal cap 3 and spot-welded at 3*a* to cap 3. A more economical or silver-saving way would be to conductively connect the axially outer end of sheet silver portion 4*b* directly to the inner end surface of cap 3, or to conductively connect a point close to the center of terminal cap 3 to the axially outer end of sheet silver portion 4*b* of fusible element 4. By so doing, the length of the silver portion 4*b* of the fusible element between the end surface of cap 3 and weld 3*a* can be saved. This can be achieved by the process known as blind soldering which relies on solder in paste form for establishing inaccessible solder joints.

Figure 5:
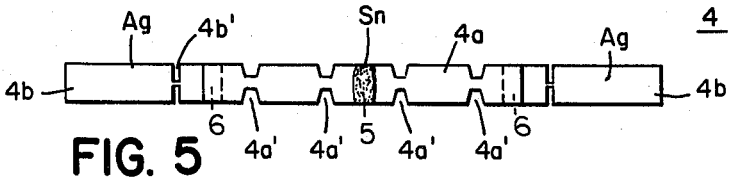
FIG. 5 is a modification of the fusible element of FIG. 1 shown in top-plan view.
Figure 6:
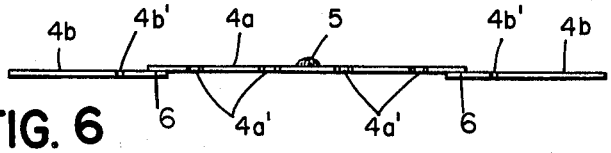
FIG. 6 is a side elevation of the fusible element shown in FIG. 5.
Figure 8:
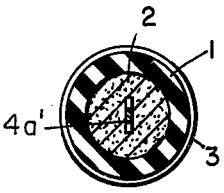
FIG. 8 is a cross-section along VII—VII of the fuse shown in FIG. 7.
Figure 7:
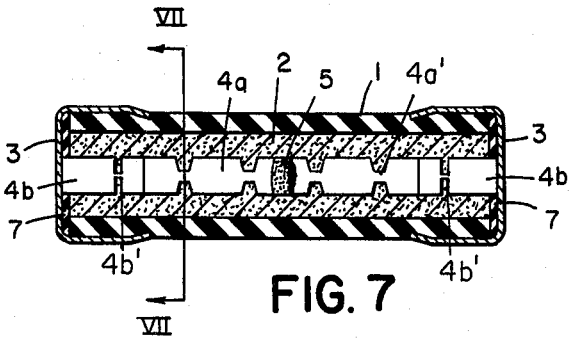
FIG. 7 is a longitudinal section of a fuse including the fusible element shown in FIGS. 5 and 6.

In FIGS. 5 to 8 the same reference characters as in FIGS. 1–4 have been applied to designate like parts. It is, therefore, sufficient to describe FIGS. 5 to 8 only to the extent that the structure shown in these figures differs from that shown in FIGS. 1 to 4.

According to FIGS. 5 to 8 the center portion 4*a* of sheet copper has two end portions 4*b* of sheet silver. The center portion 4*a* of sheet copper may have one or several points of reduced cross-section 4*a'* whose cross-section is relatively large, while each of the end portions 4*b* of sheet silver has but one single point of reduced cross-section whose cross-section is relatively small. The length of center portion 4*a* exceeds the length of each end portion 4*b*. Portions 4*a*,4*b* are spot-welded together at points 6 where they overlap.

The structures shown in the drawings operate as follows:

Under load-current and overload current conditions points 4*b* ' of sheet silver ends 4*b* will generate much heat, particularly because they are the points in the fusible element having the smallest cross-section. But since points 4*b* are so closely positioned to the terminals 3 which, in turn, remain cool because of the fact that they are in contact with a fuse holder having a large heat absorbing and heat dissipating capacity, all the heat generated at points 4*b'* will readily be dissipated by an axial heat flow toward caps 3 and the fuse holder which is in engagement with caps 3. As a result, the points of reduced cross-section 4*b'* will have no or very little effect in the load and overload range on the current-carrying capacity of the fusible element and the current rating of the fuse.

The situation is very different under short-circuit-current-like conditions. This is due to the simultaneous occurrence of three conditions indicated below:

(a) Under short-circuit-current-like conditions the rate of heating of the points of reduced cross-section 4*b'* is so fast that none of the heat generated therein by $i^2 \cdot r$ losses can escape prior to melting of point or points 4*b'*. In other words, the process of melting the points 4*b'* occurs so fast that there is no heat loss between the calculated and the actual energy required to melt the points of reduced cross-section 4*b'*,i.e. the melting process of the points of reduced cross-section is an adiabatic process.

(b) since the cross-section of points 4*b'* is less than the cross-section of points 4*a'*, the former will tend to fuse ahead of the time required for fusing points 4*a'*.

(c) The melting time of points 4*b'* is much less than the melting time of points 4*a'*, because the melting $i^2 \cdot t$ of silver in terms of $(amp/cm.^2)^2 \cdot sec.$ is much less than that of copper.

The arc voltage generated at point or points 4*b'* will keep the arc-current from rising, or rising significantly, during a short while. Thus the arc-voltage generated at the point or points 4*b'* causes a delay in the rise of the current sufficient for the points of reduced cross-section 4*a* to melt in accordance with the $i^2 \cdot t$ of points 4*a*, and the latter to generate the arc-voltage required to bring the fault current rapidly down to zero.

It should be understood that where the term point of reduced cross-section or similar expression is used in this context, this means that the total cross-section at this point is reduced, but not necessarily that the particular point does not include a plurality of parallel current paths.

I claim as my invention:

1. A current-limiting fuse including (a) a casing composed of an electric insulating material;

(b) a pulverulent arc-quenching filler inside said casing;

(c) a pair of electroconductive terminal elements closing the ends of said casing;

(d) a fusible element embedded in said arc-quenching filler and conductively interconnecting said pair of terminal elements;

(e) said fusible element including a portion of sheet copper having a first length and having one point of reduced cross-section;

(f) said fusible element further including an end portion of sheet silver having a second length shorter than said first length conductively interconnecting one of said pair of terminal elements and one end of said portion of sheet copper; and (g) said end portion of sheet silver having a single point of reduced cross-section, said single point of reduced cross-section having a smaller cross-section than any point of reduced cross-section of said portion of sheet copper.

2. A current-limiting fuse including (a) a casing comprised of synthetic-resin glass-cloth laminate;

(b) a pulverulent arc-quenching filler inside said casing;

(c) a pair of electro-conductive terminal elements closing the ends of said casing;

(d) a fusible element inside said casing, embedded in said arc-quenching filler and conductively interconnecting said pair of terminal elements;

(e) said fusible element including a relatively long portion of sheet copper and a relatively short portion of sheet silver, said portion of sheet silver interconnecting one end of said portion of sheet copper and one of said pair of terminal elements;

(f) said portion of sheet copper having a plurality of serially arranged points of reduced cross-section;

(g) said portion of sheet silver including a point of reduced cross-section resulting in an intense axial heat flow from said point of reduced cross-section toward said one of said pair of terminal elements so that said point of reduced cross-section of said portion of sheet silver has virtually no effect under load and overload conditions on the current-carrying capacity of said fusible element; and (h) the cross-section of said point of reduced cross-section of said portion of sheet silver being smaller than the cross-section of any said plurality of points of reduced cross-section of said portion of sheet copper so that under short-circuit-current-like conditions said point of reduced cross-section of said portion of sheet silver melts ahead of time of any of said plurality of points of reduced cross-section of said portion of sheet copper due to the simultaneous occurrence of the facts that under short-circuit-current-like conditions there is vitually no heat dissipation from said point of reduced cross-section of said portion of sheet silver, that the cross-section of said point of reduced cross-section of said portion of sheet silver is smaller than the cross-section of each of said plurality of points of reduced cross-section of said portion of sheet copper, and that the melting $i^2 \cdot t$ of silver is less than the melting $i^2 \cdot t$ of copper.

3. A current-limiting fuse including (a) a casing of synthetic-resin glass-cloth laminate;

(b) a pulverulent arc-quenching filler inside said casing;

(c) a pair of electro-conductive terminal elements closing the ends of said casing;

(d) a fusible element inside said casing, embedded in said arc-quenching filler and conductively interconnecting said pair of terminal elements;

(e) said fusible element including a relatively long center portion of sheet copper having at least one point of reduced cross-section and a pair of end portions of sheet silver each shorter than said center portion; and (f) each of said end portions interconnecting said center portion and one of said pair of terminal elements, and each of said end portions having but one single point of reduced cross-section of smaller cross-section than the cross-section of any point of reduced cross-section in said center portion.

* * * * *